US005751267A

United States Patent [19]

Sato et al.

[11] Patent Number: 5,751,267

[45] Date of Patent: May 12, 1998

[54] LIQUID CRYSTAL DISPLAY DEVICE

[75] Inventors: Yuji Sato, Tenri; Manabu Tanaka, Sakurai, both of Japan

[73] Assignee: Sharp Kabushiki Kaisha, Osaka, Japan

[21] Appl. No.: 607,584

[22] Filed: Feb. 27, 1996

[30] Foreign Application Priority Data

Mar. 31, 1995 [JP] Japan ..... 7-076776

[51] Int. Cl.[6] ..... G09G 3/36

[52] U.S. Cl. ..... 345/96; 345/87; 345/94; 345/209

[58] Field of Search ..... 345/87, 90, 92, 345/94, 95, 96, 99, 98, 209, 208

[56] References Cited

U.S. PATENT DOCUMENTS

| | | | |
|---|---|---|---|
| 5,280,279 | 1/1994 | Nakazawa et al. | 345/96 |
| 5,298,892 | 3/1994 | Shapiro et al. . | |
| 5,436,747 | 7/1995 | Suzuki | 345/96 |
| 5,483,256 | 1/1996 | Ohi | 345/98 |

FOREIGN PATENT DOCUMENTS

| | | |
|---|---|---|
| 0428250 A3 | 5/1991 | European Pat. Off. . |
| 5-236400 | 9/1993 | Japan . |
| 6-295164 | 10/1994 | Japan . |

*Primary Examiner*—Richard Hjerpe
*Assistant Examiner*—Kent Chang
*Attorney, Agent, or Firm*—Nixon & Vanderhye P.C.

[57] ABSTRACT

A liquid crystal device has a video interface having a reference value shifter and a level converter, which work as a gamma controller, and has a counter electrode signal generating circuit having a feedback amplifying circuit for adjusting peak-to-peak amplitude of a counter electrode signal on the basis of a control signal sent from a brightness adjuster. The reference value shifter shifts a reference value of polygonal-line approximation characteristics as much as a variation of the counter electrode signal amplitude on the basis of the control signal sent from the brightness adjuster. The level converter converts a level of an image signal in accordance with the polygonal-line approximation characteristics determined on the basis of the varying reference value, and thus compensates non-linearity of light transmittance index characteristics of liquid crystal to an applied voltage. Consequently, it is possible to provide the small, thin and cheap liquid crystal display device having a display brightness adjusting function capable of producing correct gradation.

7 Claims, 13 Drawing Sheets

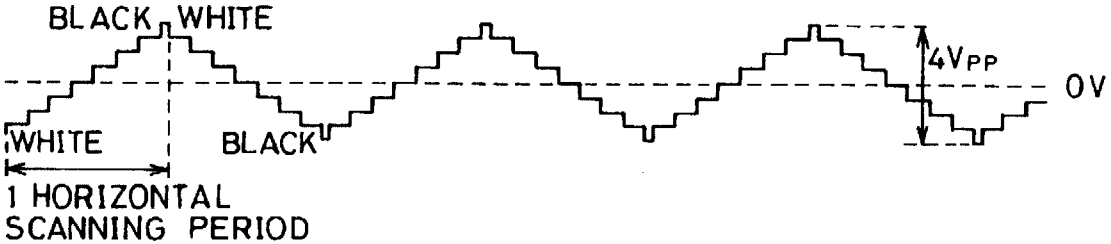
FIG. 4(a) IMAGE SIGNAL
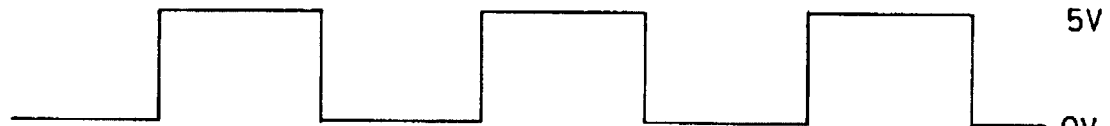
FIG. 4(b) POLARITY INVERTING SIGNAL
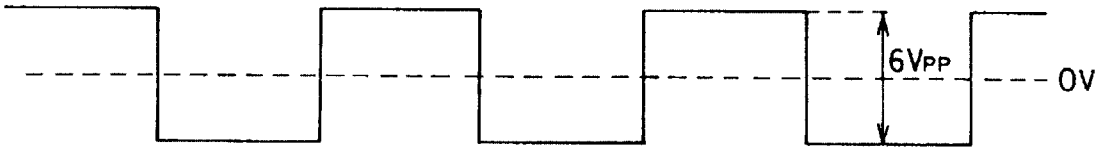
FIG. 4(c) COUNTER ELECTRODE SIGNAL
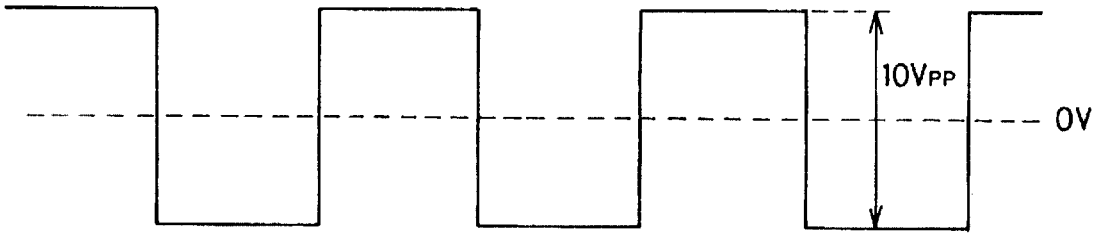
FIG. 4(d) COUNTER ELECTRODE SIGNAL
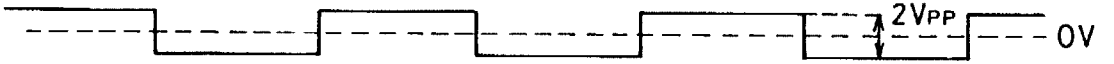
FIG. 4(e) COUNTER ELECTRODE SIGNAL

LIQUID CRYSTAL DISPLAY DEVICE

FIELD OF THE INVENTION

The present invention relates to a liquid crystal display device, such as a liquid crystal television set and a liquid crystal display, having a brightness adjusting function and being provided with pixels at crossing points of row electrodes and column electrodes in a matrix form.

BACKGROUND OF THE INVENTION

The following description will refer to a conventional example: a liquid crystal display device having an active matrix drive system which uses TFTs (Thin Film Transistors) as switching elements (hereafter, simply called a TFT-LCD).

The TFT-LCD, as shown in FIG. 12, has a liquid crystal panel 51 having:

signal electrodes 52 and gate electrodes 53 provided to cross with each other at right angles;

TFTs 55 provided near each of the crossing points of the signal electrodes 52 and the gate electrodes 53 so as to form a matrix;

pixel electrodes 54 connected to each drain of the TFTs 55; and a counter electrode 56 which is provided opposite to the pixel electrodes 54 with respect to a liquid crystal layer.

wherein each source of the TFTs 55 is connected to each of the signal electrodes 52, each gate of the TFTs 55 is connected to each of the gate electrodes 53, and the liquid crystal panel 51 is driven by a source drive circuit 57 which is connected to the signal electrodes 52 and by a gate drive circuit 58 which is connected to the gate electrodes 53.

The source drive circuit 57 receives a control signal from a drive control circuit (not shown) as well as an image signal (described later). Based on a sampling pulse of the control signal synchronizing with a horizontally synchronizing signal, the image signal which corresponds to one horizontal scanning period is transmitted to a sample & hold circuit 60 through a shift resistor 59, and then outputted to each of the signal electrodes 52 through an output buffer 61.

Meanwhile, the gate drive circuit 58 receives a control signal from the drive control circuit. Based on the control signal synchronizing with a horizontally synchronizing signal, a gate-on signal is transmitted to a level shifter 63 as the gate-on signal is sequentially shifted by a shift resistor 62. The gate-on signal is then converted by the level shifter 63 to reach a level which can turn on the TFTs 55, and outputted to each of the gate electrodes 53 through an output buffer 64.

As explained above, as the gate electrodes 53 are scanned sequentially, the TFTs 55 on the gate electrodes 53 are turned on sequentially, and a signal voltage Vs of the image signal is applied to the pixel electrodes 54.

A counter voltage Vcom as a counter electrode signal generated in a counter electrode signal generating circuit 71 is applied to the counter electrode 56 which is provided opposite to the pixel electrodes 54 with respect to the liquid crystal layer (See FIG. 15).

As a result, here occurs a potential difference between the pixel electrodes 54 to which the signal voltage Vs is applied and the counter electrode 56 to which the counter voltage Vcom is applied, the potential difference causing an electric field between the pixel electrodes 54 and the counter electrode 56. The electric field drives the liquid crystal. For example, liquid crystal used in a Normally-White TFT-LCD normally lets light pass therethrough, but blockades light when a voltage is applied thereto. The light transmittance index of this type of liquid crystal has characteristics as shown in FIG. 5. As shown in FIG. 5, the light transmittance index changes in accordance with a difference between the counter voltage Vcom and the signal voltage Vs (hereafter, referred to as the drive voltage V), thus enabling display in accordance with the image signal.

Note that when a certain voltage is constantly applied to the liquid crystal, the liquid crystal is degraded by electrolysis and flickering occurs frequently. Therefore, it is necessary to invert polarity of the drive voltage V at a predetermined frequency. It is possible to invert the polarity by switching the image signal for every horizontal scanning period while keeping the counter voltage Vcom of the counter electrode signal at a certain level. However, this causes a great peak-to-peak amplitude of the whole image signal, which then results in a high voltage supplied from the source drive circuit 57 to the signal electrodes 52. Thus, the device consumes more electricity, and the source drive circuit 57 needs a driver IC with a high withstand voltage. For the reason, the AC-Drive method has been used conventionally. The AC-Drive method employs a counter electrode signal of alternating current which can reduce the peak-to-peak amplitude of the whole image signal, while maintaining the difference between the counter voltage Vcom and the signal voltage Vs, i.e., the drive voltage V for the liquid crystal.

Incidentally, since the light transmittance index depends on viewing angles, brightness of the display vary depending on positions of a viewer: for example, looking up or down the liquid crystal panel 51. Therefore, the liquid crystal display device, such as a liquid crystal television set and a liquid crystal display, is normally provided with a brightness adjusting function to compensate the viewing angle characteristics. Thus, the liquid crystal display device can adjust the brightness so as to suit an environment in which the liquid crystal display device is used.

Such brightness adjustment is conventionally, as shown in FIG. 13, carried out by changing a voltage level of the image signal which corresponds to one horizontal scanning period. The change in the voltage level of the image signal causes a change in the whole voltage difference between the image signal and the counter electrode signal, i.e., the drive voltage V applied to the liquid crystal. As a result, the brightness of the display can be changed.

However, in the TFT-LCD of the above arrangement wherein the brightness of the display is adjusted by changing the voltage level of the image signal, the change in the voltage level of the image signal invariably causes a change in the peak-to-peak amplitude of the whole image signal. Therefore, a driver IC with high withstand voltage, or a so-called medium withstand-voltage driver IC, should be used as a driver IC of the source drive circuit 57. The medium withstand-voltage driver IC has deficiencies compared with an ordinary low withstand-voltage driver IC in terms of chip size and cost. As a result, the medium withstand-voltage -driver IC may be an obstacle in making a smaller and thinner TFT-LCD module and may further cause a cost increase of the TFT-LCD.

The present inventors, in order to solve the problems and make it possible to use the low withstand-voltage driver IC as the driver IC of the source drive circuit 57, proposed a different method of adjusting the brightness of the display as disclosed in Japanese Laid-Open Patent Application No. 7-295164/1995 (hereafter referred to as the voltage-lowering method). The disclosed voltage-lowering method changes the voltage level of the counter electrode signal corresponding to one horizontal line period as shown in FIG. 14, instead of changing the voltage level of the image signal corresponding to one horizontal line period. The voltage-lowering method thus changes the voltage difference between the image signal and the counter electrode signal, thereby changing the brightness of the display. To be more specific, as shown in FIG. 15, a user sets a target brightness through a brightness adjusting section 72 for setting the brightness of the display. A brightness control signal in accordance with the target brightness is sent from the brightness adjusting section 72 to the counter electrode signal generating circuit 71. The counter electrode signal generating circuit 71 generates the counter electrode signal by amplifying a polarity inverting signal in accordance with the brightness control signal through a feedback amplifying circuit (not shown) which is part of an amplitude adjusting section. In this manner, the present inventors have succeeded in making a smaller, thinner and cheaper liquid crystal display device having the display brightness adjusting function.

Meanwhile, the light transmittance index has unique characteristics as shown in FIG. 7. Therefore, it is necessary to carry out a compensation with respect to the image signal in accordance with the characteristics in order to achieve good gradation. Generally, this type of compensation is called a gamma control. The image signal is adjusted in terms of brightness in order to be inputted into a liquid crystal module like the one above. The gamma control compensates the voltage applied to the liquid crystal in accordance with the level of the adjusted image signal.

FIG. 8 shows characteristics of the transmittance index after the voltage applied to the liquid crystal, i.e., the drive voltage, is compensated to be proportional to the transmittance index. Suppose the characteristics shown in FIGS. 7 and 8 are represented as A and B respectively, B is obtainable by compensating A, in other words, by multiplying A by a compensation factor 'B÷A'. FIG. 9 shows transmittance-drive voltage characteristics of the compensation factor in accordance with this idea (hereafter referred to as compensation characteristics). The drive voltage becomes proportional to the transmittance index as shown in FIG. 8 by converting the level of the image signal in accordance with the compensation characteristics. Note that, in practice, only an approximate compensation is carried out with respect to the light transmittance index characteristics of the liquid crystal panel 51 in order to simplify a circuit. For example, the ideal compensation characteristics can be substituted for by polygonal-line approximation characteristics having two inflection points $\gamma_1$ and $\gamma_2$ as shown in FIG. 10. Therefore, the level of the image signal is, in practice, converted in accordance with the polygonal-line approximation characteristics. The inflection point voltages $\gamma_1$ and $\gamma_2$ of this type of polygonal-line approximation characteristics are determined on the basis of a certain reference value of the image signal.

Incidentally, under a certain condition, the good gradation can be obtained with the TFT-LCD which changes the brightness by changing the voltage level of the image signal corresponding to one horizontal line period. The condition is, as shown in FIG. 16, that the inflection point voltages $\gamma_1$ and $\gamma_2$ of the polygonal-line approximation characteristics are determined on the basis of an off-set point L of the counter electrode signal, or in other words, on the basis of a reference point of the image signal. Under this condition, the inflection point voltages $\gamma_1$ and $\gamma_2$ do not change even if the voltage level of the image signal changes and causes a voltage change as much as variation $\alpha$. Thus, the good gradation can be maintained.

However, the above TFT-LCD employing the voltage-lowering method changes the amplitude of the counter electrode signal, instead of changing the voltage level of the image signal corresponding to one horizontal line period. Such a change in the amplitude then changes the drive voltage applied to the liquid crystal, thereby changing the brightness of the display. Therefore, as shown in FIG. 17, the voltage-lowering method has a problem if the inflection point voltages $\gamma_1$ and $\gamma_2$ of the polygonal-line approximation characteristics are determined on the basis of the off-set point L of the counter electrode signal, or in other words, on the basis of the reference point of the image signal. The problem is that when the amplitude of the counter electrode signal changes, the inflection point voltages $\gamma_1$ and $\gamma_2$ of the polygonal-line approximation characteristics changes as much as the variation $\alpha$. Hence, the compensation is incomplete and results in an insufficient gradation.

SUMMARY OF THE INVENTION

In view of the above problems, an object of the present invention is to provide a small, thin and cheap liquid crystal display device having a brightness adjusting function capable of producing correct gradation.

In order to achieve the above object, a liquid crystal display device in accordance with the present invention has:

display electrodes;

a counter electrode provided opposite to the display electrodes with respect to a liquid crystal layer;

a brightness setting section for setting display brightness;

image signal generating means for generating an image signal whose polarity is inverted at a predetermined frequency;

signal voltage applying means for applying to the display electrodes a signal voltage in accordance with the image signal; and counter electrode signal generating means for generating a counter electrode signal whose polarity is inverted in synchronism with the polarity inversion frequency of the image signal and for supplying the generated counter electrode signal to the counter electrode, wherein the counter electrode signal generating means has an amplitude adjusting section for adjusting peak-to-peak amplitude of the counter electrode signal on the basis of a setting through the brightness setting section, and the image signal generating means has:

a level conversion section for converting level of the image signal in accordance with compensation characteristics which are determined on the basis of a reference value and compensate non-proportionality of the transmittance index of liquid crystal to an applied voltage; and a reference value shifting section for shifting the reference value of the compensation characteristics as much as a variation of the counter electrode signal amplitude which is adjusted on the basis of the setting through the brightness setting section.

With the arrangement, the reference value shifting section provided in the image signal generating means shifts the reference value of the compensation characteristics as much as the variation of the counter electrode signal amplitude which is adjusted on the basis of the setting through the brightness setting section. On the basis of the reference value shifted in accordance with the variation of the counter electrode signal amplitude, the level conversion section of an image signal compensation section converts the level of the image signal in accordance with the compensation characteristics for compensating the non-linearity of the transmittance index of the liquid crystal to the applied voltage. Moreover, the counter electrode signal generating means, provided with the amplitude adjusting section, can adjust the amplitude of the counter electrode signal on the basis of the setting through the brightness setting section. The arrangement thus changes the voltage applied to the liquid crystal (the drive voltage) and changes the display brightness.

Accordingly, it is possible to properly compensate the image signal so that the transmittance index of the liquid crystal becomes proportional to the applied voltage regardless of the amplitude variation of the counter electrode signal. The correct gradation is thus achieved. Consequently, the liquid crystal display device in accordance with the present invention is small, thin and cheap, and can produce the correct gradation despite having the display brightness adjusting function.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, are not in any way intended to limit the scope of the claims of the present invention.

BRIEF DESCRIPTION OF THE DRAWINGS

FIGS. 4(*a*) through 4(*e*) are timing charts showing an image signal, a polarity inverting signal and counter electrode signal of the TFT-LCD:

FIG. 4(*a*) showing a waveform of the image signal,

FIG. 4(*b*) showing a waveform of the polarity inverting signal, and

FIGS. 4(*c*) through 4(*e*) showing waveforms of counter electrode signals wherein each of the waveforms has a different amplitude from each other.

DESCRIPTION OF THE EMBODIMENT

Referring to FIGS. 1 through 11, the following description will discuss an embodiment in accordance with the present invention.

Figure 2:
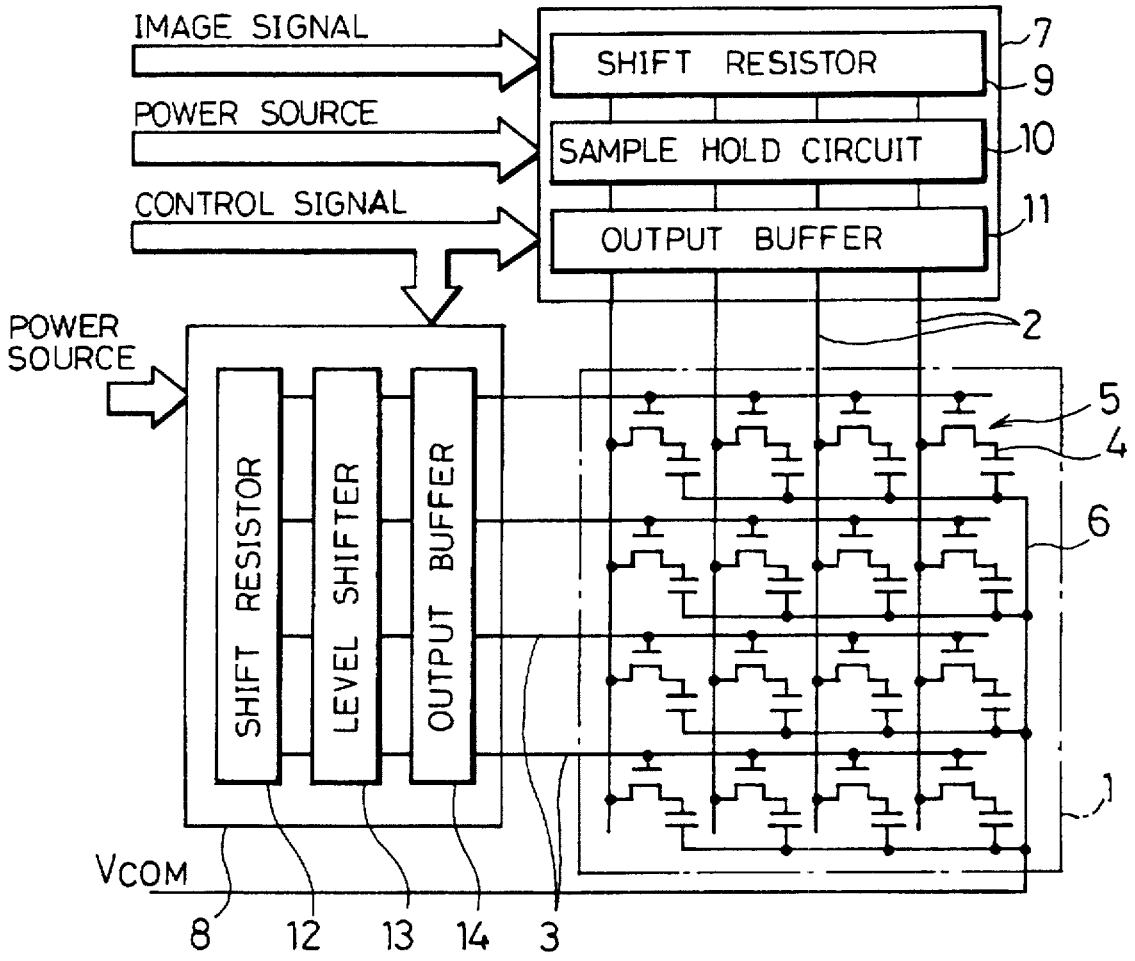
FIG. 2 is an explanatory view showing structure of a liquid crystal panel and a drive section thereof in the TFT-LCD.

A liquid crystal display device of the present embodiment, as shown in FIG. 2, is of an active matrix drive system type which uses TFTs 5 as switching elements (hereafter, simply referred to as a TFT-LCD). Here, a Normally-White TFT-LCD will be explained. The Normally-White TFT-LCD normally lets light pass therethrough, but blockades light when a voltage is applied thereto.

The TFT-LCD has a TFT substrate provided with TFTs 5 in a matrix form, a counter substrate provided opposite to the TFT substrate, and a liquid crystal panel 1 having liquid crystal layer provided between the TFT and counter substrates and two polarizing plates. On the TFT substrate of the liquid crystal panel 1, signal electrodes 2 and gate electrodes 3 are provided to cross with each other at right angles. The signal electrodes 2 and the gate electrodes 3 are made of transparent conductive films and of a stripe-like shape. Near crossing points of the signal electrodes 2 and the gate electrodes 3 on the TFT substrate, the TFTs 5 and pixel electrodes (display electrodes) 4 are provided. The pixel electrodes 4 are made of transparent conductive films. Each source of the TFTs 5 is connected to each of the signal electrodes 2. Each drain of the TFTs 5 is connected to each of the pixel electrodes 4. Each gate of the TFTs 5 is connected to each of the gate electrodes 3. On the counter substrate, a counter electrode 6 is provided. The counter electrode 6 is made of a transparent conductive film.

The liquid crystal panel 1 is driven by a source drive circuit (signal voltage applying means) 7-which is connected to the signal electrodes 2 and a gate drive circuit 8 which is connected to the gate electrodes 3.

Figure 1:
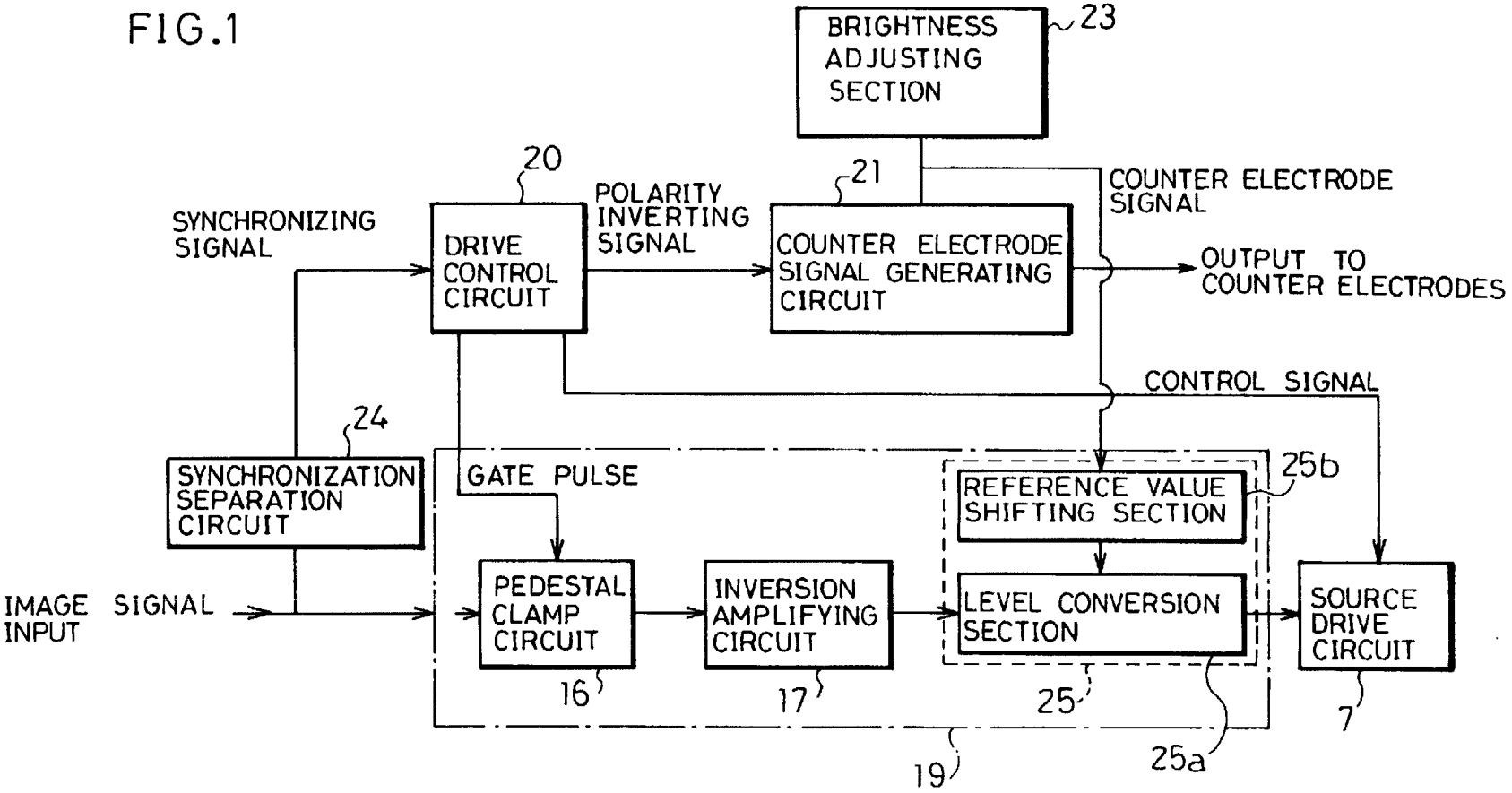
FIG. 1 is a block diagram showing structure of a main part, for a signal processing, of a TFT-LCD of an embodiment in accordance with the present invention.

The source drive circuit 7 is a low withstand-voltage driver IC which is mainly composed of a shift resistor 9, a sample & hold circuit 10 and an output buffer 11. A power source device (not shown) provides power supply to the source drive circuit 7. Besides, as shown in FIG. 1, the source drive circuit 7 receives an image signal from a video interface 19 and receives a control signal from a drive control circuit 20. The video interface 19 will be, hereafter, referred to as simply the video I/F 19 and explained later in detail.

The gate drive circuit 8 is basically composed of a shift resistor 12, a level shifter 13 and an output buffer 14. The power source device provides power supply to the gate drive circuit 8. Besides, the gate drive circuit 8 receives a control signal from the drive control circuit 20.

A counter voltage Vcom (a counter electrode signal generated by a counter electrode signal generating circuit 21 shown in FIG. 1) is applied to the counter electrode 6 which is provided opposite to the pixel electrodes 4 with respect to the liquid crystal layer.

Figure 3:
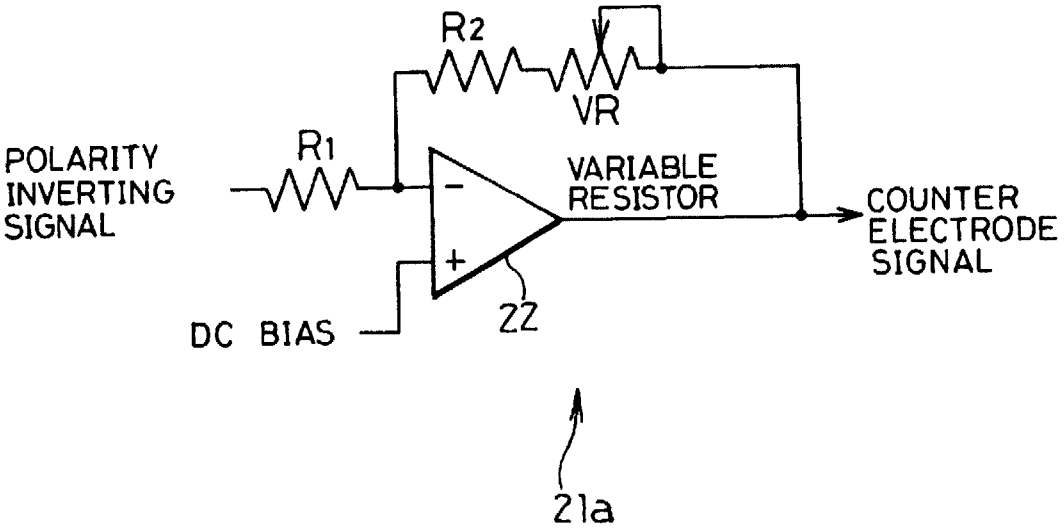
FIG. 3 is a circuit diagram showing a counter electrode signal generating circuit in the TFT-LCD.

The counter electrode signal generating circuit 21 generates a counter electrode signal by amplifying a polarity inverting signal (see FIG. 4(*b*)) through a feedback amplifying circuit (amplitude adjustment section) 21*a* (see FIG. 3). An example of the counter electrode signal thus generated by the counter electrode signal generating circuit 21 is shown in FIG. 4(*c*). The polarity inverting signal here is generated by the drive control circuit 20 and has a pulse width corresponding to one horizontal scanning period. The feedback amplifying circuit 21*a* is composed of resistors R1 and R2, variable resistor VR and an amplifier 22. The amplifier 22 receives a DC voltage at a positive input terminal thereof and receives the polarity inverting signal through the resistor R1 at a negative input terminal thereof. An output of the amplifier 22 is fed back into the negative input terminal of the amplifier 22 through the resistor R2 and the variable resistor VR. The resistor R2 and the variable resistor VR are connected in series with each other. Consequently, it is possible to change the output of the amplifier 22, i.e., a peak-to-peak amplitude of the counter electrode signal, by changing a resistance value of the variable resistor VR. Examples of the counter electrode signal output from the amplifier 22 are shown in FIGS. 4(*c*) through 4(*e*). The resistance value of the variable resistor VR is determined by a brightness control signal in accordance with brightness set through a brightness adjusting section (brightness setting section) 23 (see FIG. 1). The brightness adjusting section 23 is provided on an outer surface of a device.

The TFT-LCD is provided with the video I/F (image signal generating means) 19. The video I/F 19 generates the image signal of a waveform suitable for driving the liquid crystal by processing the inputted image signal separated from, for example, a television signal. The video I/F 19, as shown in FIG. 1, has a pedestal clamp circuit 16, an inversion amplifying circuit 17 and a gamma control section (image signal compensation section) 25. The pedestal clamp circuit 16 makes pedestal level of the image signal constant. The inversion amplifying circuit 17 inverts polarity of the image signal at a predetermined frequency (one frequency equals one horizontal scanning period). The gamma control section 25 carries out a gamma control with respect to the image signal. The image signal is outputted to the source drive circuit 7 through the video I/F 19.

The gamma compensation section 25, which carries out the so-called gamma control, is made up of a level conversion section 25*a* and a reference value shifting section 25*b*.

Figure 10:
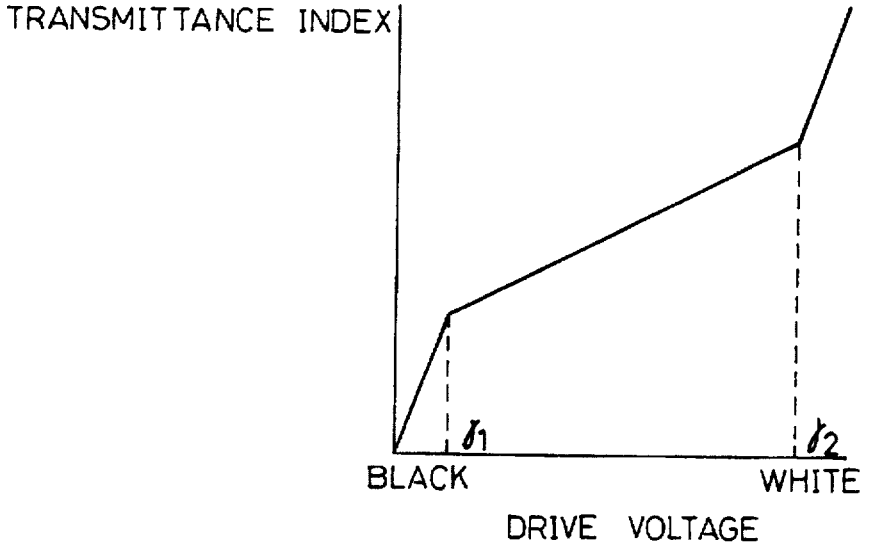
FIG. 10 is a graph showing polygonal-line approximation characteristics which is actually used instead of the real compensation characteristics.

The level conversion section 25*a* converts the level of the image signal from the inversion amplifying circuit 17. The level conversion is carried out in accordance with a polygonal-line approximation characteristics having inflection points $\gamma_1$ and $\gamma_2$ as shown in FIG. 10. The voltage levels of the inflection points $\gamma_1$ and $\gamma_2$ are determined on the basis of a variable reference value which changes in accordance with a variation of the counter electrode signal amplitude.

It is necessary to carry out the gamma control for the following reason.

Figure 5:
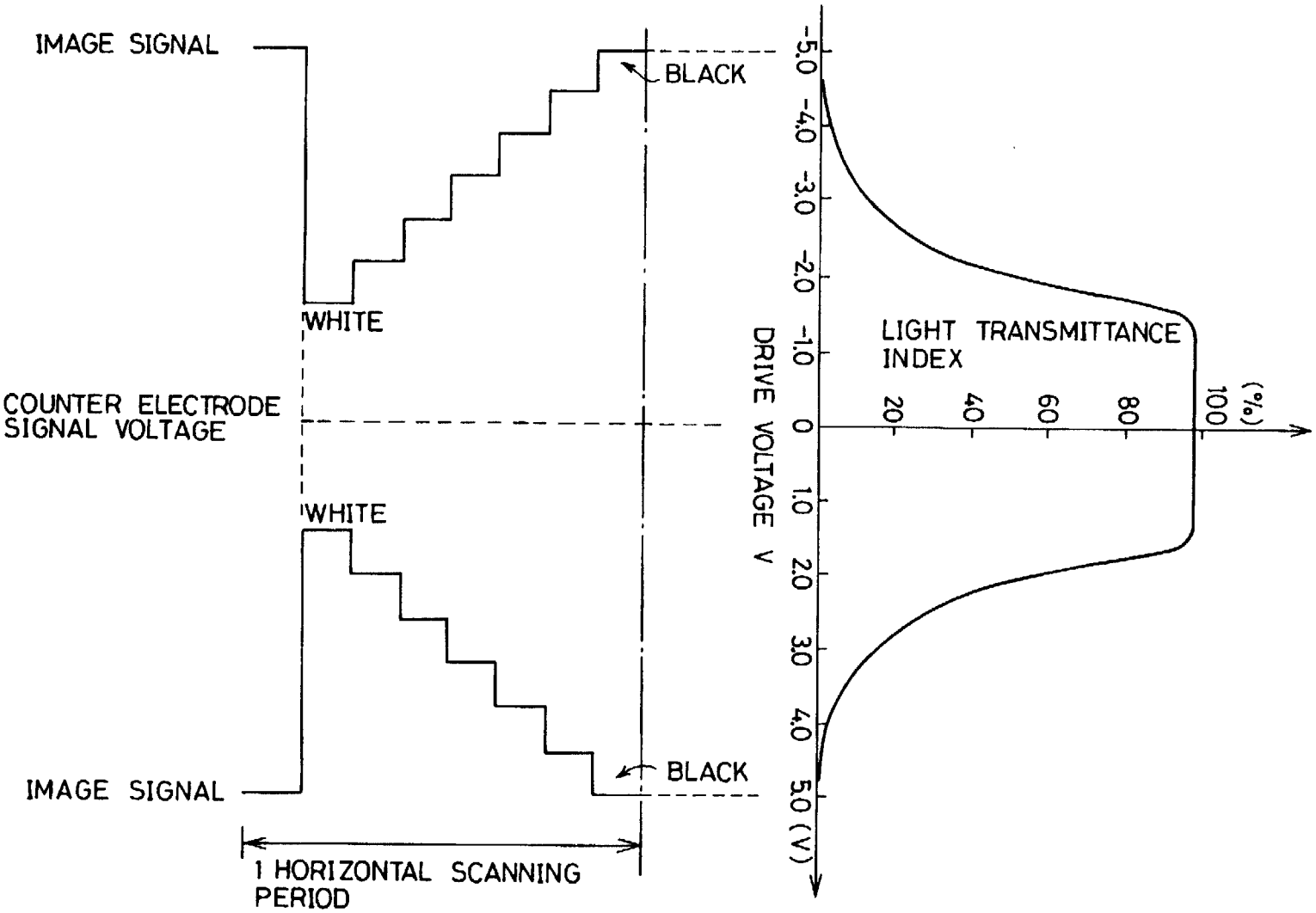
FIG. 5 is an explanatory graph showing correlation between drive voltage and light transmittance index of liquid crystal and further showing correlation between light transmittance index characteristics and image signal waveforms.
Figure 7:
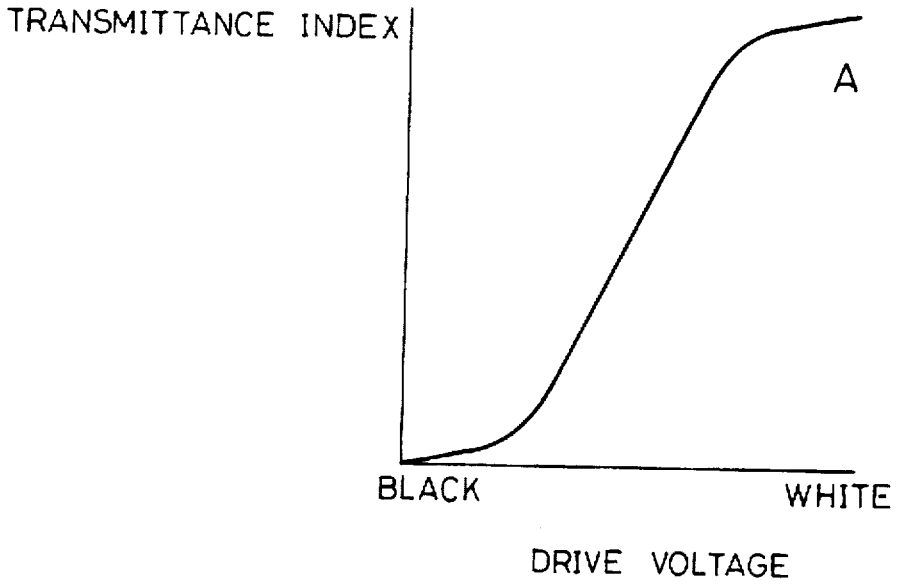
FIG. 7 is a graph showing the light transmittance index characteristics of the liquid crystal.
Figure 8:
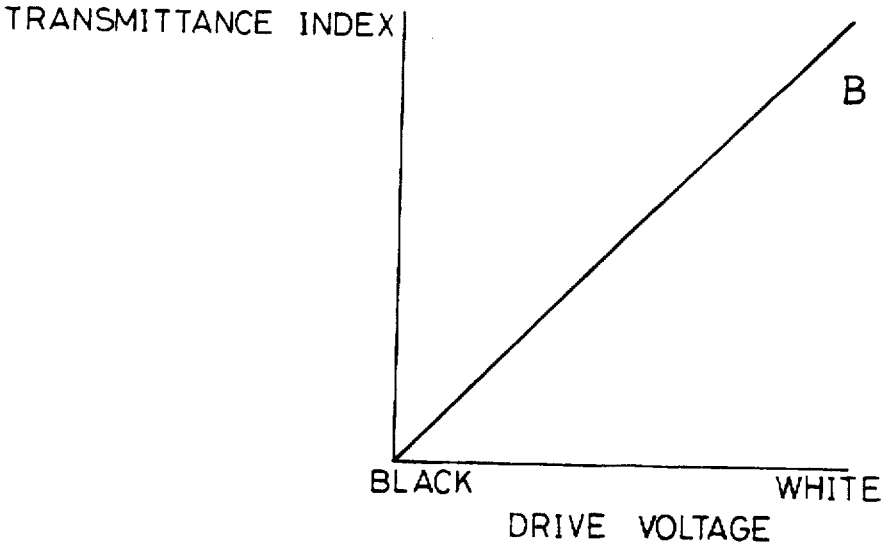
FIG. 8 is a graph showing light transmittance index characteristics of the liquid crystal after a compensation.
Figure 9:
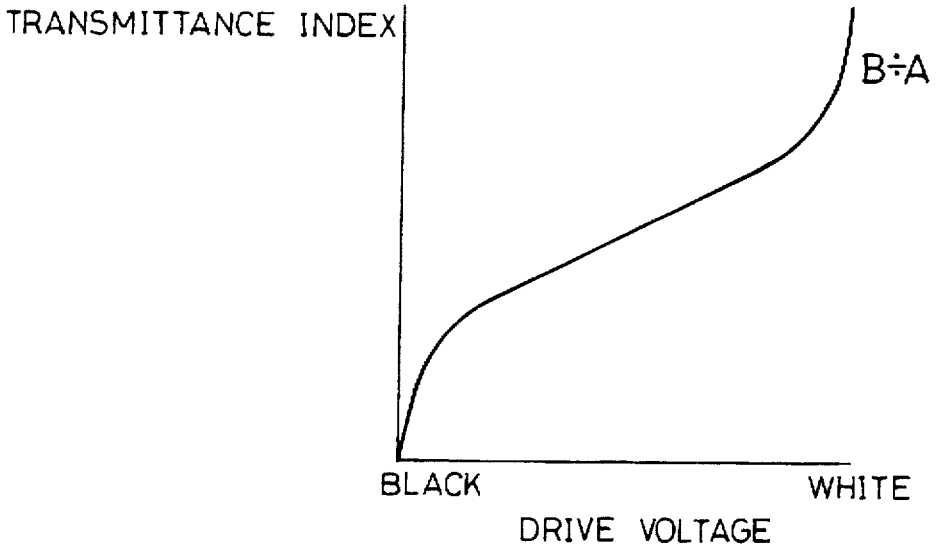
FIG. 9 is a graph showing compensation characteristics to compensate the light transmittance index characteristics of the liquid crystal.

Light transmittance index of the liquid crystal constituting the liquid crystal panel 1 has unique characteristics as shown in FIGS. 5 and 7. Therefore, it is necessary to carry out the so-called gamma control with respect to the image signal in accordance with the unique characteristics in order to achieve good gradation. FIG. 8 shows characteristics of the transmittance index after the compensation is carried out so that the drive voltage applied to the liquid crystal becomes proportional to the transmittance index. Suppose the characteristics shown in FIGS. 7 and 8 are represented as A and B respectively. B is obtainable by compensating A, in other words, by multiplying A by a compensation factor 'B+A'. FIG. 9 shows transmittance-drive voltage characteristics of the compensation factor in accordance with this idea. The drive voltage becomes proportional to the transmittance index as shown in FIG. 8 by converting the level of the image signal in accordance with the compensation characteristics. However, a very complex circuit is needed in order to carry out the compensation which exactly incorporates these compensation characteristics as shown in FIG. 9. Therefore, the compensation is carried out approximately with respect to the light transmittance index characteristics of the liquid crystal. In other words, the level of the image signal is converted in accordance with the polygonal-line approximation characteristics having the inflection points $\gamma_1$ and $\gamma_2$ as shown in FIG. 10. Note that the number of inflection points may be more than two. The more inflection points are employed, the closer the actual compensation is to the ideal compensation as shown in FIG. 9.

Figure 11:
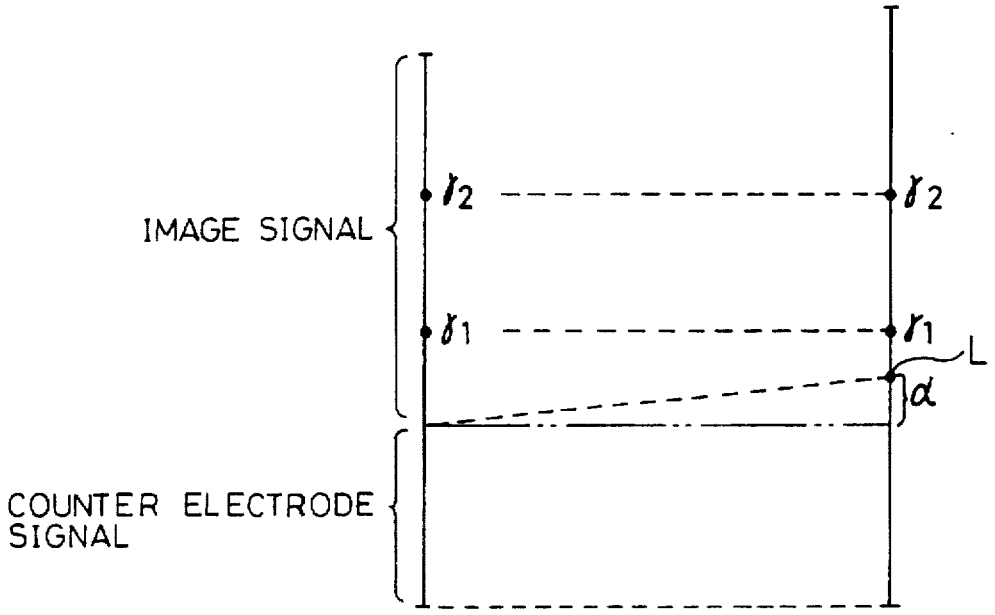
FIG. 11 is an explanatory drawing showing position shifts of inflection points in accordance with a gamma control of the TFT-LCD.
Figure 12:
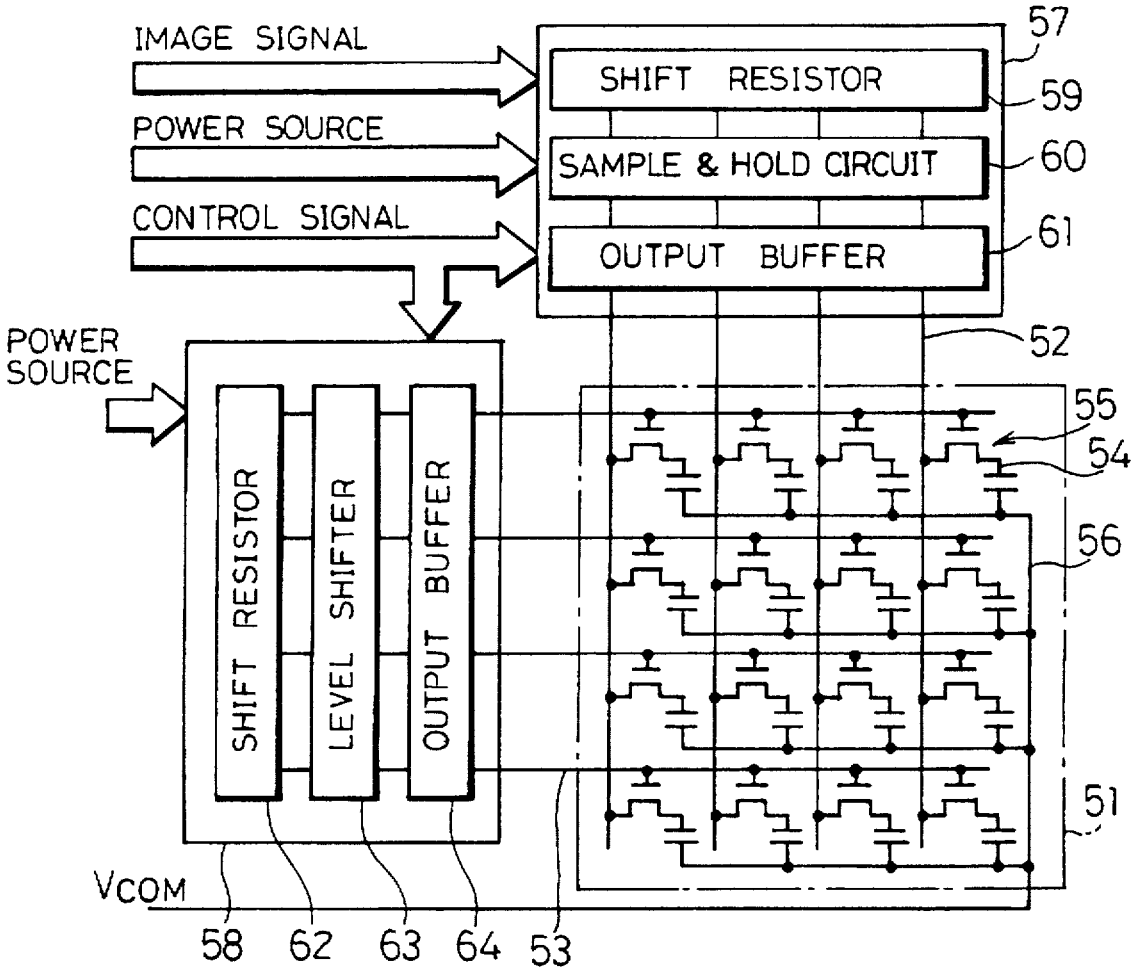
FIG.12 (PRIOR ART)
FIG. 12 is an explanatory view showing structure of a liquid crystal panel and a drive section thereof in a TFT-LCD in accordance with a conventional method.
Figure 13:
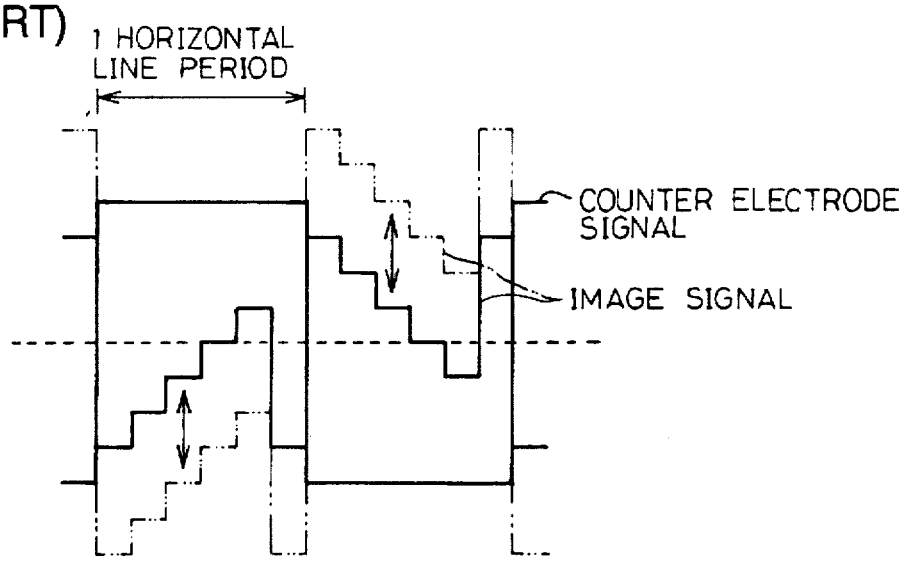
FIG.13 (PRIOR ART)
FIG. 13 is a waveform chart showing waveforms of an image signal and a counter electrode signal in accordance with the conventional method.
Figure 14:
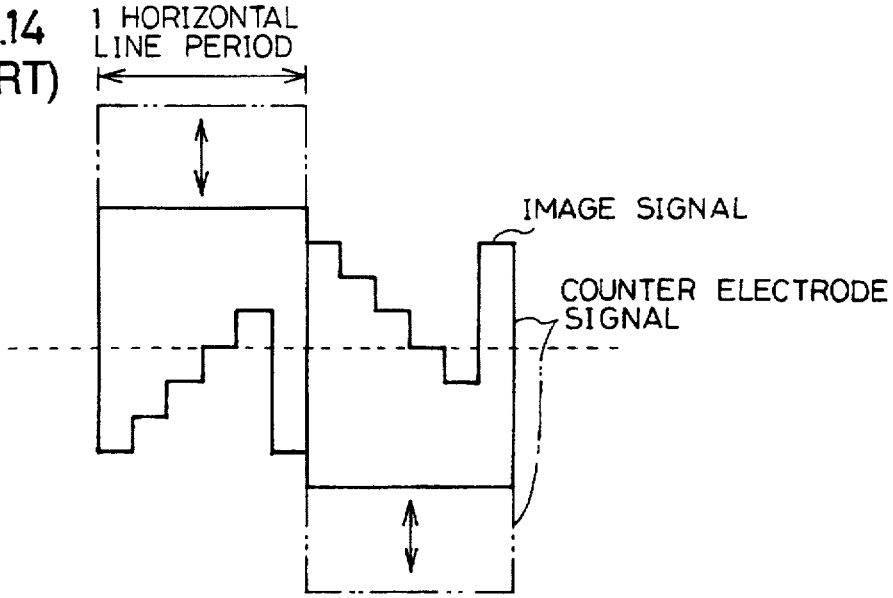
FIG.14 (PRIOR ART)
FIG. 14 is a waveform chart showing waveforms of an image signal and a counter electrode signal of a voltage-lowering method.
Figure 15:
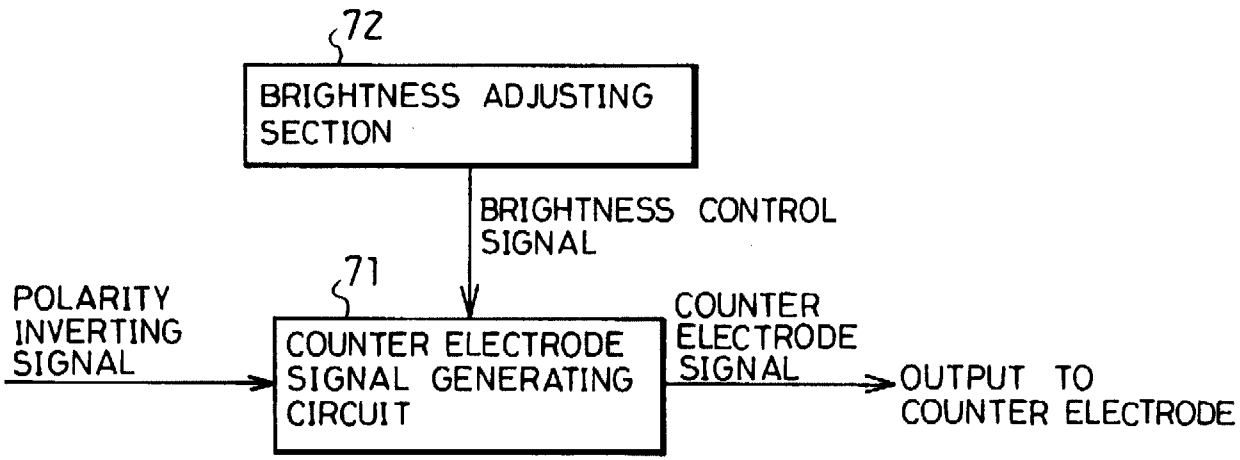
FIG. 15 is a block diagram showing structure for adjusting brightness of a display of a TFT-LCD employing the voltage-lowering method.
Figure 16:
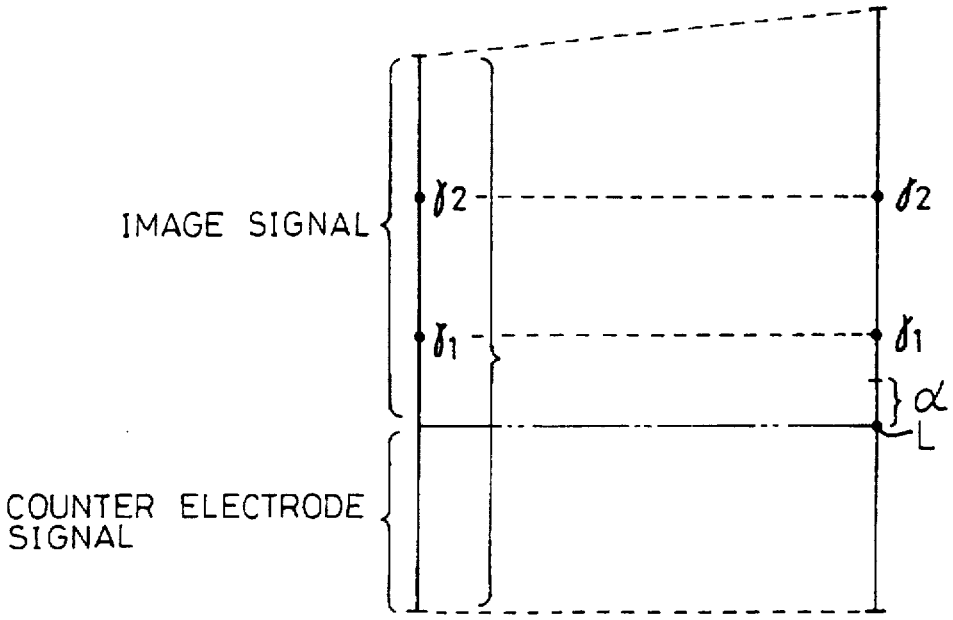
FIG. 16 is an explanatory drawing showing positions of inflection points when a gamma control is carried out with respect to a liquid crystal drive voltage in accordance with the conventional method.
Figure 17:
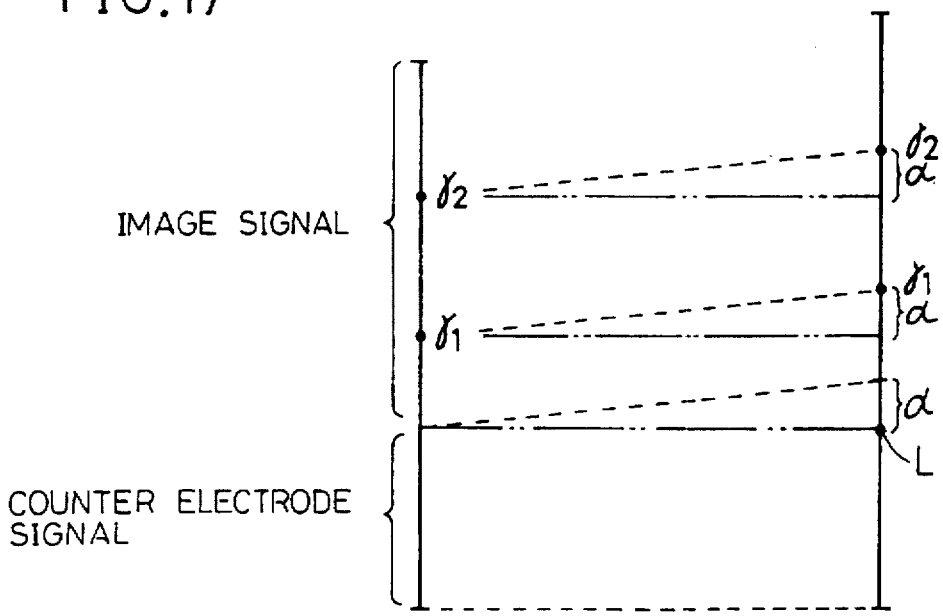
FIG. 17 is an explanatory drawing showing positions of inflection points when a gamma control is carried out with respect to a voltage applied to the liquid crystal under the condition where in accordance with the conventional method the brightness is adjusted by changing amplitude of the counter electrode signal.

Meanwhile, the reference value shifting section 25*b* changes the reference value of the polygonal-line approximation characteristics employed by the level conversion section 25*a*. The reference value shifting section 25*b* carries out this change on the basis of the brightness control signal in accordance with the brightness set through the brightness setting section 23. To be more specific, the reference value shifts together with a variation of the counter electrode signal amplitude. Accordingly, the reference value shifting section 25*b* shifts the reference value to a direction opposite to the above shift direction, which causes the reference value to be fixed at the same value. Namely, the reference value of the polygonal-line approximation characteristics is shifted as much as variation a of the counter electrode signal. The variation $\alpha$ is in accordance with the brightness control signal sent from the brightness setting section 23. As a result of the shift of the reference value, the inflection points $\gamma_1$ and $\gamma_2$ of the polygonal-line approximation characteristics are fixed at a predetermined voltage level as shown in FIG. 11. The shift of the reference value is necessary for the following reasons. The peak-to-peak amplitude of the counter electrode signal varies, for example as in FIGS. 4(*c*) to 4(*e*), as the setting of the variable resistor VR of the counter electrode signal generating circuit 21 changes in accordance with the brightness control signal sent from the brightness setting section 23. The varying amplitude results in a shift of the off-set point L of the counter electrode signal, or in other words, in a shift of the reference point of the image signal. Therefore, if the voltage level of the image signal is compensated on the basis of the off-set point L, the inflection points $\gamma_1$ and $\gamma_2$ also shift according to the shift of the off-set point L. Hence, it is impossible to carry out a correct compensation in accordance with the drive voltage.

The TFT-LCD has a synchronization separation circuit 24 and the drive control circuit 20. The synchronization separation circuit 24 separates the synchronizing signal from the inputted image signal. The drive control circuit 20, on the basis of the synchronizing signal sent from the synchronization separation circuit 24, generates various signals: for example, the control signal for controlling operations of the source drive circuit 7 and the gate drive circuit 8, the polarity inverting signal supplied to the counter electrode signal generating circuit 21, and a gate pulse for clamping a pedestal level portion of the image signal.

Operations of the TFT-LCD in the above arrangement is explained hereafter.

First, as shown in FIG. 1, the original image signal separated from, for example, a television signal is inputted to the video I/F 19 and the synchronization separation circuit 24. The synchronization separation circuit 24 separates horizontally and vertically synchronizing signals from the original image signal and outputs the horizontally and vertically synchronizing signals to the drive control circuit 20. The drive control circuit 20 forms the gate pulse for clamping the pedestal level portion of the image signal and outputs the gate pulse to the pedestal clamp circuit 16 of the video I/F 19. In order to form the gate pulse, the drive control circuit 20 utilizes a delay circuit (not shown) and delays for a predetermined time the horizontally synchronizing signal sent from the synchronization separation circuit 24.

In the video I/F 19, firstly, the pedestal level portion of the image signal is maintained at a constant value by the pedestal clamp circuit 16. Then, the polarity of the image signal is inverted at a predetermined frequency by the inversion amplifying circuit 17. As a result, the image signal input has a waveform, for example, as in FIG. 4(*a*). Here, level difference between the black level and the white level of the image signal outputted from the inversion amplifying circuit 17 (i.e., the peak-to-peak amplitude of the whole image signal) is set at around 4 v wherein the light transmittance index in accordance with the light transmittance index characteristics of the liquid crystal shown in FIG. 5 can vary between maximum and minimum values.

The image signal outputted from the inversion amplifying circuit 17 is supplied to the gamma compensation section 25. The level of the image signal is converted by the level conversion section 25*a* in accordance with the polygonal-line approximation characteristics having the inflection points $\gamma_1$ and $\gamma_2$ as shown in FIG. 10. The inflection points $\gamma_1$ and $\gamma_2$ are fixed at constant voltage levels respectively, even if the amplitude of the counter electrode signal varies. This is because the reference value of the polygonal-line approximation characteristics is shifted by the reference value shifting section 25*b* according to the inputted brightness control signal. For example, it is assumed that the off-set point L of the counter electrode signal is shifted as much as the variation $\alpha$ in accordance with the amplitude variation of the counter electrode signal responding to the brightness control signal as shown in FIG. 11. In order to prevent the voltage levels of the inflection points $\gamma_1$ and $\gamma_2$ from shifting as much as the variation $\alpha$ with the above shift of the off-set point L, the reference value shifting section 25*b* shifts the reference value of the polygonal-line approximation characteristics as much as the variation $\alpha$ to the direction opposite to the shift direction of the off-set point L. As a result, the inflection points $\gamma_1$ and $\gamma_2$ are respectively fixed at constant voltage levels regardless of the amplitude variation of the counter electrode signal as shown in FIG. 11.

The image signal formed by the video I/F 19 is then supplied to the source drive circuit 7.

The source drive circuit 7 receives the control signal from the drive control circuit 20 as well as the above image signal. Based on a sampling pulse of the control signal in synchronism with the horizontally synchronizing signal, the image signal corresponding to one horizontal scanning period is transmitted to the sample & hold circuit 10 through the shift resistor 9, and then outputted to each of the signal electrodes 2 through the output buffer 11 as shown in FIG. 2.

Meanwhile, the gate drive circuit 8 receives the control signal from the drive control circuit 20. Based on the control signal, a gate-on signal is transmitted to the level shifter 13 as the gate-on signal shifts in the shift resistor 12 sequentially. The gate-on signal is then converted in the level shifter 13 to reach a level capable of turning on the TFTs 5, and outputted to each of the gate electrodes 3 through the output buffer 14.

In this manner, as the gate electrodes 3 are scanned sequentially, the TFTs 5 on the gate electrodes 3 are turned sequentially, and a signal voltage Vs of the image signal is applied to the pixel electrodes 4.

Meanwhile, on the basis of the synchronizing signal sent from the synchronization separation circuit 24, the drive control circuit 20 generates the polarity inverting signal with the pulse width corresponding to one horizontal scanning period as shown in FIG. 4(*b*). The polarity inverting signal is outputted to the counter electrode signal generating circuit 21. Besides, when the user operates the brightness adjusting section 23, the brightness adjusting section 23 sends the brightness control signal to the counter electrode signal generating circuit 21. The brightness control signal changes the setting of the variable resistor VR of the counter electrode signal generating circuit 21 shown in FIG. 3. The change in the setting changes a gain of the feedback amplifying circuit 21*a*. The feedback amplifying circuit 21*a* then generates and outputs the counter electrode signal with the varying peak-to-peak amplitude. Examples of such counter electrode signals are shown in FIGS. 4(*c*) to 4(*e*). The counter electrode signal thus generated is supplied to the counter electrode 6 provided opposite to the pixel electrodes 4 with respect to the liquid crystal layer.

As a result, here occurs a potential difference between the pixel electrodes 4 to which the signal voltage Vs of the image signal is applied and the counter electrode 6 to which the counter voltage Vcom of the counter electrode signal is applied, the potential difference causing an electric field. The electric field drives the liquid crystal and thus enables display in accordance with the image signal. In the TFT-LCD, the voltage level of the image signal supplied to the source drive circuit 7 (See FIG. 4(*a*)) is maintained at a constant value. Therefore, as mentioned above, the difference between the signal voltage and the counter voltage (i.e., the drive voltage V applied to the liquid crystal) changes on the whole as the amplitude of the counter electrode signal changes. The drive voltage V thus can provide the display brightness in accordance with the change of the counter electrode signal.

Figures 6A, 6B, 6C:
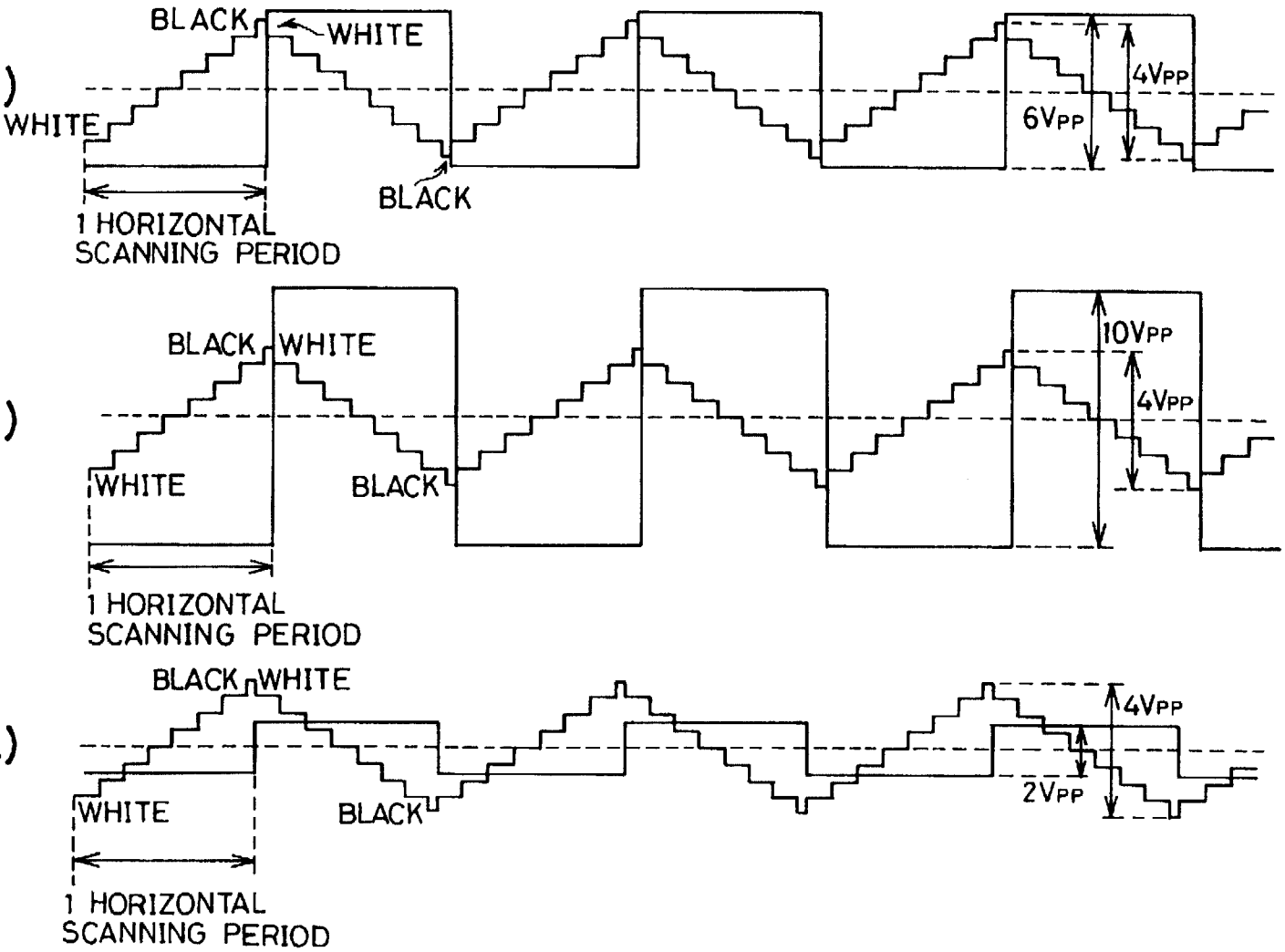
FIGS. 6(*a*) through 6(*c*) are waveform charts showing waveforms of image signals and counter electrode signals of the TFT-LCD, each of the waveforms of the counter electrode signals having a different amplitude from each other.

Note that FIGS. 4(*a*) to 4(*e*) show waveforms of the signals upon being supplied to the source drive circuit 7. A time when the image signal is supplied to the pixel electrodes 4 differs from a time when the signals are supplied to the source drive circuit 7. The time difference corresponds to one horizontal scanning period and is caused by a sampling hold operation of the source drive circuit 7. FIGS. 6(*a*) to 6(*c*) show the image signal in FIG. 4(*a*) overlapping with the counter electrode signals in FIGS. 4(*c*) to 4(*e*) at a time when the signal voltage Vs and the counter voltage Vcom are applied to the liquid crystal layer.

In short, the TFT-LCD of the embodiment employs the arrangement where the peak-to-peak amplitude of the counter electrode signal generated by the counter electrode signal generating circuit 21 changes according to the brightness control signal sent from the brightness adjusting section 23. With the arrangement, the reference value shifting section 25*b* of the gamma control section 25 provided in the video I/F 19 shifts the reference value of the polygonal-line approximation characteristics as much as the amplitude variation of the counter electrode signal which is adjusted on the basis of the setting through the brightness adjusting section 23. The level conversion section 25*a* then converts the level of the image signal in accordance with the polygonal-line approximation characteristics determined on the basis of the shifted reference value. The TFT-LCD of the embodiment thus compensates the non-linearity of the transmittance index of the liquid crystal to the applied voltage.

The TFT-LCD of the embodiment employs the arrangement where the amplitude of the counter electrode signal, instead of the voltage level of the image signal, is changed in order to change the voltage applied to the liquid crystal, and the change in the applied voltage consequently changes the brightness of the display. Even with the arrangement, the TFT-LCD properly compensates the image signal so that the transmittance index of the liquid crystal becomes proportional to the drive voltage regardless of the varying amplitude of the counter electrode signal. The correct gradation is thus achieved.

Consequently, the present invention can obtain the small, thin and cheap TFT-LCD of the embodiment having the brightness adjusting function capable of producing the correct gradation.

Note that a positive display type TFT-LCD is used in the above embodiment. But the embodiment can be also applied to an active display type TFT-LCD, to a dynamic drive type LCD not employing switching elements which are used in the TFT-LCD and even to a static drive type LCD.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device, comprising: display electrodes;

a counter electrode provided opposite to said display electrodes with respect to a liquid crystal layer;

a brightness setting section for setting display brightness;

image signal generating means for generating an image signal whose polarity is inverted at a predetermined frequency;

signal voltage applying means for applying to said display electrodes a signal voltage in accordance with the image signal; and counter electrode signal generating means for generating a counter electrode signal whose polarity is inverted in synchronism with the polarity inversion frequency of the image signal and for supplying the generated counter electrode signal to said counter electrode, wherein said counter electrode signal generating means includes an amplitude adjusting section for adjusting peak-to-peak amplitude of the counter electrode signal on the basis of a setting through said brightness setting section, and said image signal generating means includes:

a level conversion section for converting level of the image signal in accordance with compensation characteristics which are determined on the basis of a reference value and compensate non-linearity of the transmittance index of liquid crystal to an applied voltage; and a reference value shifting section for shifting the reference value of the compensation characteristics as much as a variation of the counter electrode signal amplitude which is adjusted on the basis of the setting through said brightness setting section.

2. The liquid crystal display device as defined in claim 1, wherein said level conversion section converts the level of the image signal in accordance with polygonal-line approximation characteristics having at least two inflection points, and said reference value shifting section changes the reference value of the polygonal-line approximation characteristics as much as the variation of the counter electrode signal amplitude, and thus fixes positions of the inflection points regardless of the variation of the counter electrode signal amplitude.

3. The liquid crystal display device as defined in claim 1, wherein the amplitude adjusting section includes a feedback amplifying circuit having a variable resistor, and adjusts the peak-to-peak amplitude of the counter electrode signal by changing a set value of the variable resistor on the basis of a control signal sent from said brightness setting section.

4. The liquid crystal display device as defined in claim 1, wherein said signal voltage applying means is a low withstand-voltage driver IC.

5. The liquid crystal display device as defined in claim 4, wherein said signal voltage applying means further includes a sample & hold circuit for sampling and holding an input image signal.

6. The liquid crystal display device as defined in claim 1, wherein each pixel has a switching element for switching a supply of the signal voltage to each of said display electrodes.

7. The liquid crystal display device as defined in claim 6, wherein the switching element is a thin film transistor (TFT).

* * * * *